US008806988B2

(12) United States Patent
Chang

(10) Patent No.: US 8,806,988 B2
(45) Date of Patent: Aug. 19, 2014

(54) ADJUSTABLE WRENCH

(76) Inventor: Hsueh-O Hsu Chang, Taichung (TW)

( * ) Notice: Subject to any disclaimer, the term of this patent is extended or adjusted under 35 U.S.C. 154(b) by 217 days.

(21) Appl. No.: 13/615,524

(22) Filed: Sep. 13, 2012

(65) Prior Publication Data

US 2014/0069238 A1 Mar. 13, 2014

(51) Int. Cl.
*B25B 13/20* (2006.01)
*B25B 13/46* (2006.01)
*B25B 13/50* (2006.01)

(52) U.S. Cl.
USPC ..... 81/126; 81/186

(58) Field of Classification Search
USPC ..... 81/126–129, 134, 186
See application file for complete search history.

(56) References Cited

U.S. PATENT DOCUMENTS 1,354,552 A * 10/1920 Hart ..... 81/127
1,427,364 A * 8/1922 Dobrzanski ..... 81/57.5
1,660,208 A * 2/1928 Preining ..... 81/127
1,771,172 A * 7/1930 Fraser ..... 81/127
1,794,818 A * 3/1931 Abrahamson ..... 81/127
2,223,306 A * 11/1940 Mead ..... 81/127
2,285,603 A * 6/1942 Mead ..... 81/127
2,590,792 A * 3/1952 Reneer ..... 81/127
3,290,970 A * 12/1966 De Lucia ..... 81/127
3,354,758 A * 11/1967 Slayton ..... 81/126
3,572,190 A * 3/1971 Oeland, Jr. ..... 81/127
3,803,954 A * 4/1974 Lenker ..... 81/126
4,989,479 A * 2/1991 Anderson et al. ..... 81/424.5
5,016,503 A * 5/1991 Morton ..... 81/127
6,216,564 B1 * 4/2001 Pasbrig ..... 81/135
8,733,214 B2 * 5/2014 Hsu ..... 81/126
2001/0020404 A1 * 9/2001 Chang-Kao ..... 81/127

* cited by examiner

*Primary Examiner* — David B Thomas

(57) ABSTRACT

An adjustable wrench includes a fixed jaw base, an adjustable jaw base and a handle. The adjustable jaw base includes a slide rod which is slidably movable in a slide grove of the fixed jaw base to adjust the space to clip an object. A poke rod of the handle is located in a poke recess of the slide rod to provide an action force or a limit force to the slide rod. The slide rod is provided with a spring to react to the action force or limit force of the poke rod. One side of the fixed jaw base has a first operation portion for the user to press and control the space to clip the object, enhancing the convenience to turn a workpiece. Particularly, when the handle is pivoted, the poke rod in the poke recess will direct act on the center of the slide rod.

6 Claims, 12 Drawing Sheets

ADJUSTABLE WRENCH

BACKGROUND OF THE INVENTION

1. Field of the Invention

The present invention relates to a wrench, and more particularly to, an adjustable wrench which can turn a workpiece conveniently and smoothly.

2. Description of Related Art

An adjustable wrench is used to turn a pipe member, a screw or a nut. The adjustable wrench comprises a screw member to move an adjustable jaw so that the opening between the adjustable jaw and the fixed jaw can be adjusted to clip a workpiece. In fact, it is difficult to know the size of the required opening. The screw member needs to be adjusted many times to fit on the workpiece. This is quite troublesome when in use. Besides, when the wrench is operated at an angle which is hard to turn the workpiece or there is an obstacle during the operation, the user has to adjust the wrench at a proper angel to turn the workpiece. The entire operation is complicated and the work efficiency is low.

Taiwan Patent Publication No. 136716 discloses an adjustable wrench, which uses a movable wrench to adjust the screw member and link a cylindrical rack. This wrench can turn the workpiece continuously, but it is necessary to adjust the screw member for different workpieces. It is inconvenient for use.

Taiwan Patent Publication No. 388313 discloses an adjustable wrench, which comprises a jaw body and a handle body. One end of the jaw body is pivotally connected to the handle body. The front end of the handle body is provided with a first toothed block to engage with a second toothed block at the lower edge of a movable jaw block. The handle body is swung relative to the jaw body to move the clip block, so that the opening between a first jaw of the jaw body and a second jaw of the clip block can be adjusted. Though the opening can be adjusted conveniently, there is no limit to confine the maximum and minimum opening through the swing of the handle body. It is not beneficial to adjust a desired opening with one handle. When the opening is enlarged by the angled portion of the nut, the opening cannot automatically restore to the required size for turning the workpiece. The jaw body must be applied with an external force to clip the workpiece again by the swing of the handle body. This is not beneficial to turn the workpiece continuously. When turning the workpiece, the force from the first toothed rack of the handle body to drive the clip block doesn't direct act on the track of the clip block. During slide, a part of the first toothed block compresses the second toothed block of the clip block to move. After a period of time, the slide may be jammed to influence its normal function.

Accordingly, the inventor of the present invention has devoted himself based on his many years of practical experiences to solve these problems.

SUMMARY OF THE INVENTION

The primary object of the present invention is to provide a wrench which comprises a fixed jaw base, an adjustable jaw base and a handle. The fixed jaw base comprises an end surface at a front end thereof, a pivot portion at a rear end thereof, a curved first operation portion between one side of the end surface and the pivot portion, a first jaw extending forward from another side of the end surface, a slide groove formed in the front end of the fixed jaw base and parallel to the end surface, a pin hole extending through the fixed jaw base and perpendicular to the slide groove, a pivot through hole at the pivot portion, and a trough in the pivot portion to communicate with the slide groove. The adjustable jaw base comprises a slide rod which corresponds in shape to the slide groove of the fixed jaw base and is slidably movable in the slide groove. The slide rod has an elongated spring room and a poke recess at one side of the spring room. A spring is provided in the spring room. One end of the spring is fixed to a pin member inserted in the pin hole, and another end of the spring is in the spring room and normally pushes the slide rod to move towards the first jaw. The slide rod has a second jaw extending forward from a front end thereof and corresponding to the first jaw. The second jaw is against the end surface and moved along with movement of the slide rod in the slide groove to adjust the gap between the first and second jaws to form a space for clipping an object. The handle has a connection portion at one end thereof. The connection portion is inserted into the trough of the pivot portion of the fixed jaw base. The connection portion has a connection hole and a poke rod corresponding to the poke recess of the slide rod of the adjustable jaw base. An axle pin is inserted through the pivot hole and the connection hole to connect the pivot portion and the connection portion. The poke rod is normally inserted in the poke recess of the slide rod. The user holds the handle to push the first operation portion, and then the fixed jaw base is pivoted about the axle pin. The poke rod of the handle is in the poke recess to stop the slide rod of the adjustable jaw base during swing and after swing, such that the slide rod of the adjustable jaw base is slid in the slide groove of the fixed jaw base relative to the first jaw. Through the compression or damping effect of the spring, the space can be quickly adjusted in a manual way according to the size of a workpiece. When the first operation portion is released, the slide rod is pushed back by the force of the spring. The workpiece is clipped quickly by the first and second jaw portions. When the handle is pivoted clockwise, the poke rod is moved in the poke recess of the slide rod towards the first jaw and the space is reduced so that the workpiece in the space is clipped tightly by the first and second jaws. The handle is further turned to bring rotation (clockwise rotation) of the workpiece. When the handle is turned reversely (counterclockwise), the poke rod is moved reversely in the poke recess and the force of the second jaw to clip the workpiece is released. The workpiece is not driven by the handle. The handle only brings the first and second jaws to return. At this time, the slide rod is still biased by the spring so the first and second jaws keep the state to clip workpiece. When the reverse turning of the handle is stopped, the workpiece is turned clockwise. The workpiece is turned continuously at a certain operation angle. The slide rod of the adjustable jaw base is slid in the slide groove of the fixed jaw base to adjust the size of the space. The poke rod of the handle is located in the poke recess of the slide rod to activate or limit the slide rod. The spring in the slide rod is adapted to respond to the force of the poke rod. Accordingly, the first operation portion at one side of the fixed jaw base is for the user to adjust the space with his/her finger to provide convenience when in use. Particularly, the poke rod of the handle is in the poke recess to act on the slide rod about at the central position. This can provide a stable action force and prevent the slide rod in the slide grove from being jammed, having a smooth operation to turn the workpiece continuously.

Preferably, the curved first operation portion is located between one side of the end surface and the pivot portion, and the first jaw extends forward from the other side of the end surface. The fixed jaw base further has a protruding second operation which is disposed between the first jaw and the pivot portion and corresponds to the first operation portion.

When the user holds the handle, the second operation portion is selectively pressed downward to adjust the size of the space. Both the first and second operation portions are able to adjust the space. Thus, no matter the workpiece is turned clockwise or counterclockwise, the user can hold the handle to push the first operation portion or to press the second operation portion downward to adjust the space. The present invention can be used conveniently and conforms to anthropometry.

Preferably, the pivot portion of the fixed jaw base is connected with the connection portion of the handle. The connection portion is inserted into the trough and the poke rod extends into the poke recess of the slide rod of the adjustable jaw base. The poke recess is a U-shaped recess, and has a width slightly greater than the width of the poke rod and a depth slightly greater than the length of the poke rod. When the handle is pivoted, the poke rod will apply an axial force to the side wall of the poke recess to push the slide rod, preventing the poke rod from compressing the slide rod to diverge from the center of the slide groove. This ensures that the compressing elasticity of the spring won't be influenced and the slide rod can be returned effectively. The poke rod extends into the U-shaped poke recess of the slide rod. The slide rod has a stepped notch next to the poke recess. The poke rod has a protrusion corresponding to the notch. When the user holds the handle but doesn't operate the wrench to clip an object, the slide rod biased by the spring is positioned by the protrusion of the poke rod to engage with the notch, preventing the fixed jaw base and the adjustable jaw base at the front end of the handle from swaying before use.

Preferably, the slide rod of the adjustable jaw base has the elongated spring room. A limit pin is provided inside the spring room. The spring is disposed in the spring room. One end of the spring is fixed by the pin member, and the other end of the spring is fitted on the limit pin to push the slide rod. Through the limit pin, the spring is located in the spring room stably.

Preferably, the space is defined between the first jaw of the fixed jaw base and the second jaw of the adjustable jaw base. The first and second jaws have curved anti-slip surfaces which face the space and have snap threads thereon. When the wrench is used to clip a circular-tube or a circular-rod workpiece, the anti-slip surfaces are beneficial to clip the workpiece for operation.

Preferably, the space is defined between the first jaw of the fixed jaw base and the second jaw of the adjustable jaw base. The first jaw is located opposite the second jaw. The first and second jaws have flat surfaces which are perpendicular to the end surface. The space is adapted to clip a hexagonal screw or a hexagonal nut. The handle is operated to turn the workpiece. When the handle is returned, the flat surfaces of the first and second jaws make the hexagonal screw or nut return to the original position for continuous turning. The space is defined between the first jaw of the fixed jaw base and the second jaw of the adjustable jaw base. The first and second jaws have the flat surfaces facing each other. The first and second jaws of the fixed jaw base and the adjustable jaw base have bent surfaces located next to inner ends of the flat surfaces and corresponding in shape to the angled portion of a hexagonal screw or nut. The bent surfaces are adapted to hold against the angled portion of the workpiece when the flat surfaces of the first and second jaws clip the flat portion of the workpiece, enhancing the stability of turning.

The above and other objects, features and advantages of the invention will become apparent from the following detailed description taken with the accompanying drawings.

DETAILED DESCRIPTION OF THE INVENTION

Embodiments of the present invention will now be described, by way of example only, with reference to the accompanying drawings.

Figure 1:
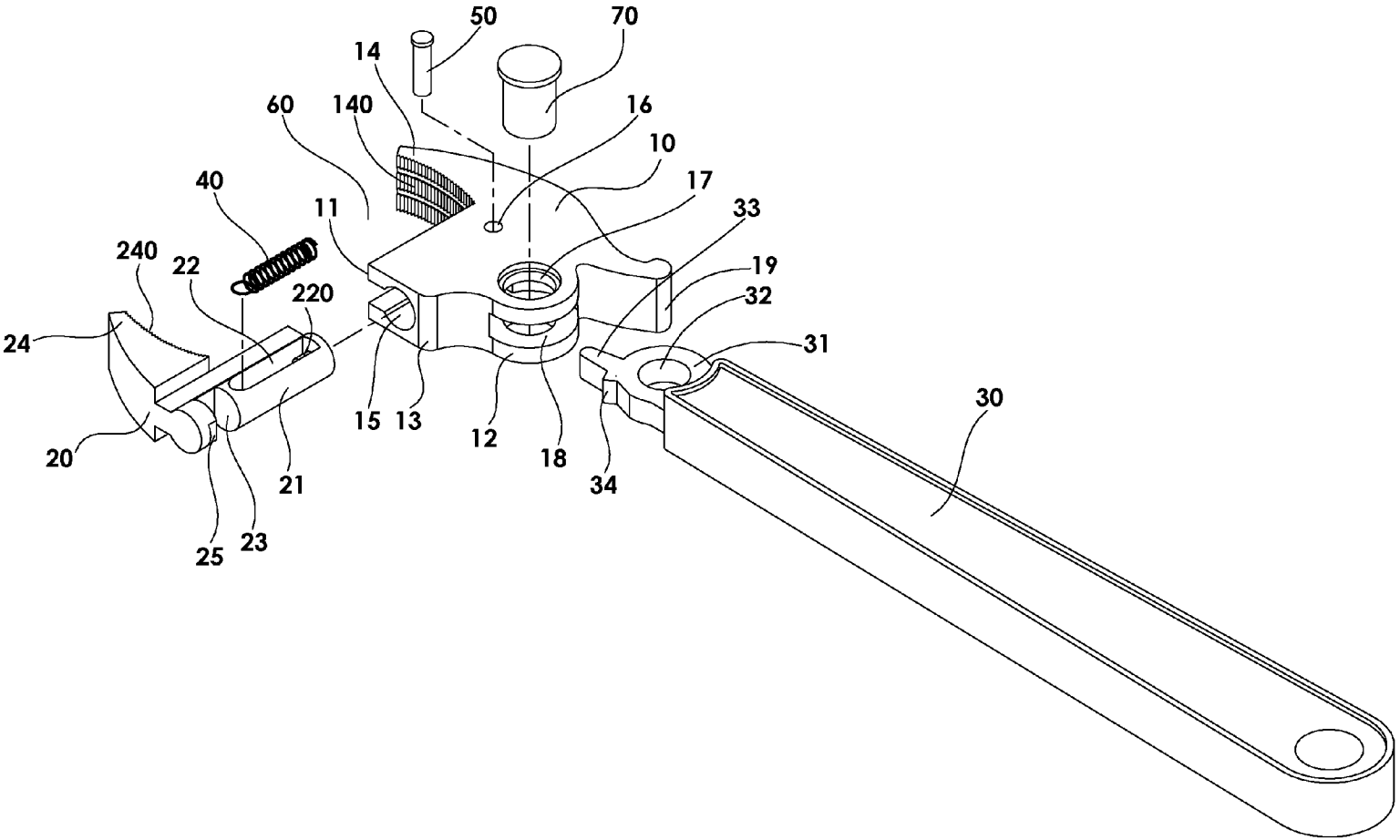
FIG. 1 is an exploded view according to a preferred embodiment of the present invention.
Figure 2:
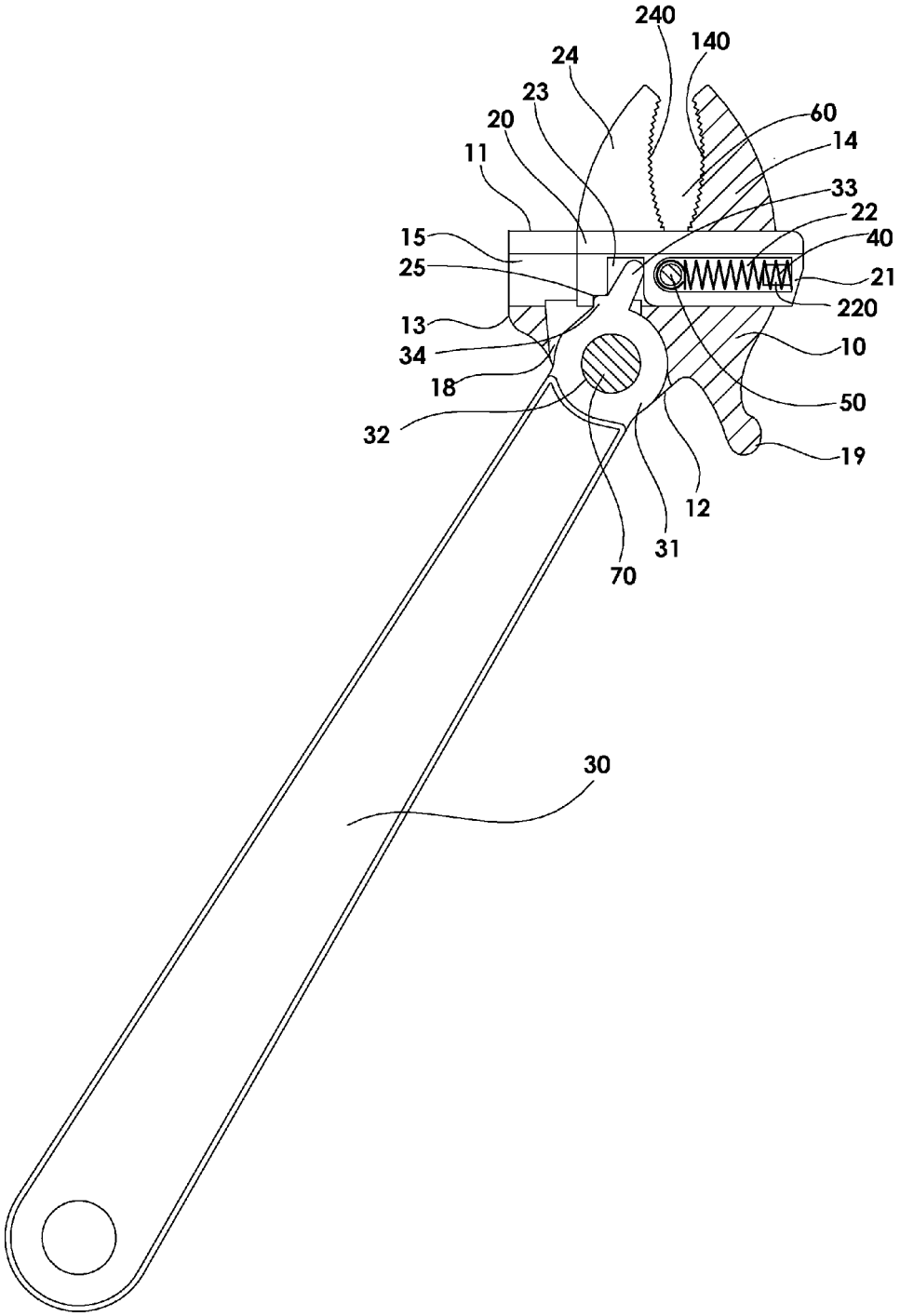
FIG. 2 is a sectional view showing the fixed jaw base according to the preferred embodiment of the present invention.
Figure 3:
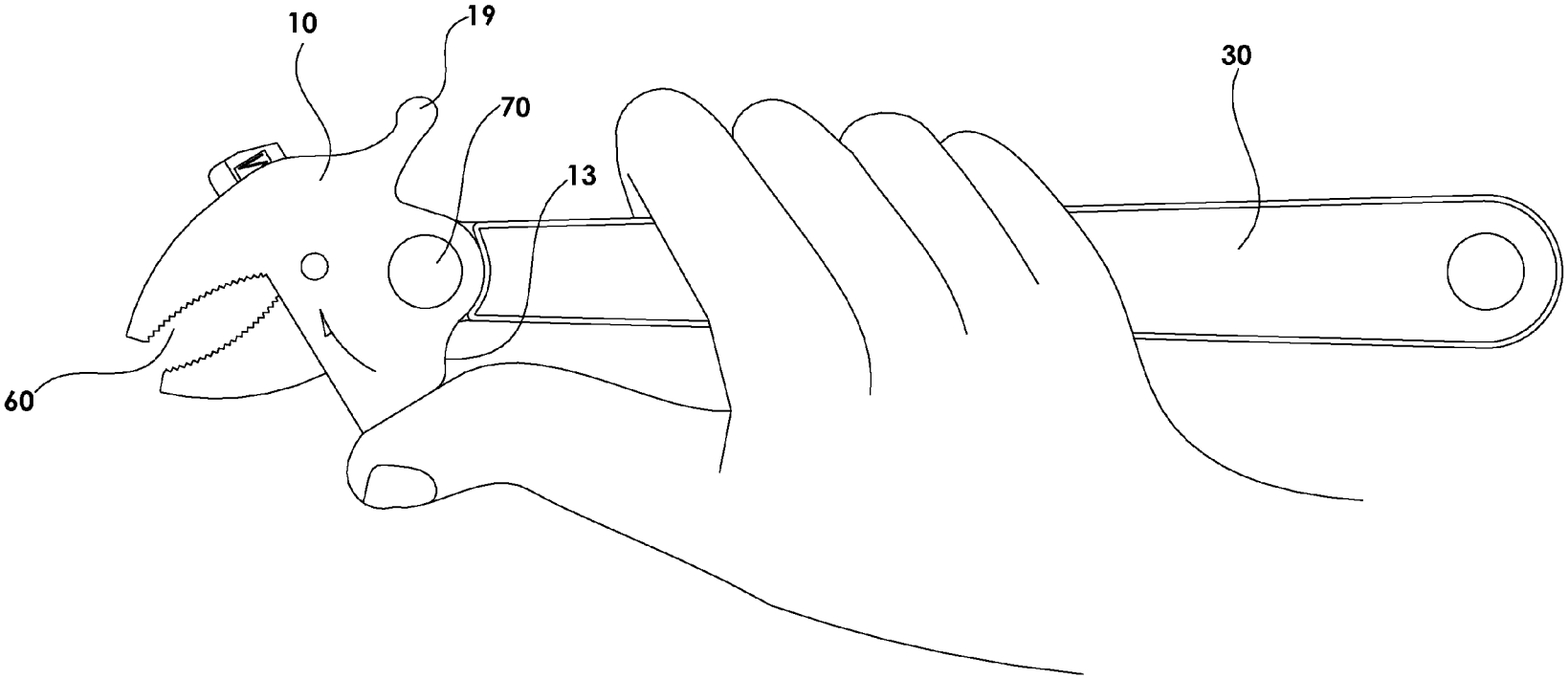
FIG. 3 is a schematic view showing the space to clip an object according to the preferred embodiment of the present invention.
Figure 4:
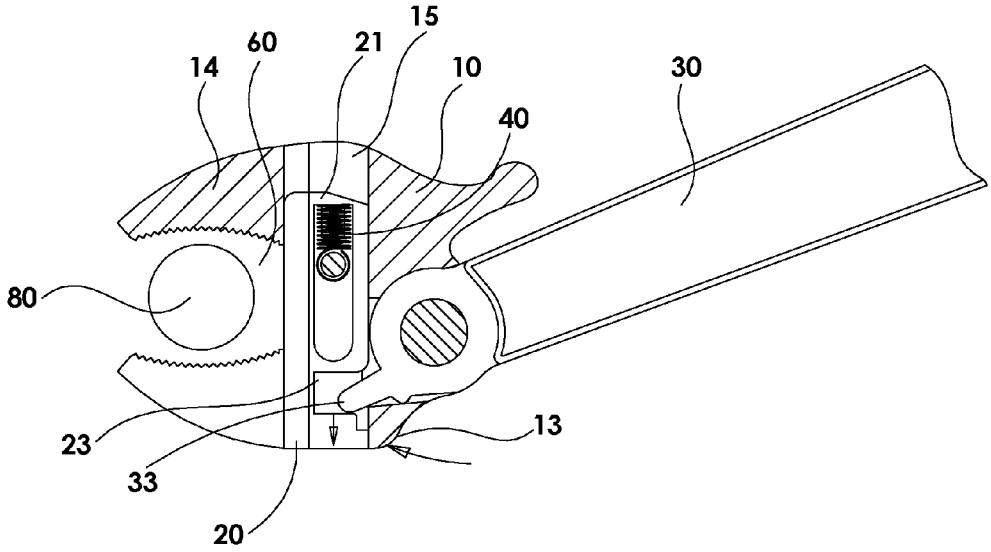
FIG. 4 is a schematic view showing that the space is adjusted to clip an object according to the preferred embodiment of the present invention.
Figure 5:
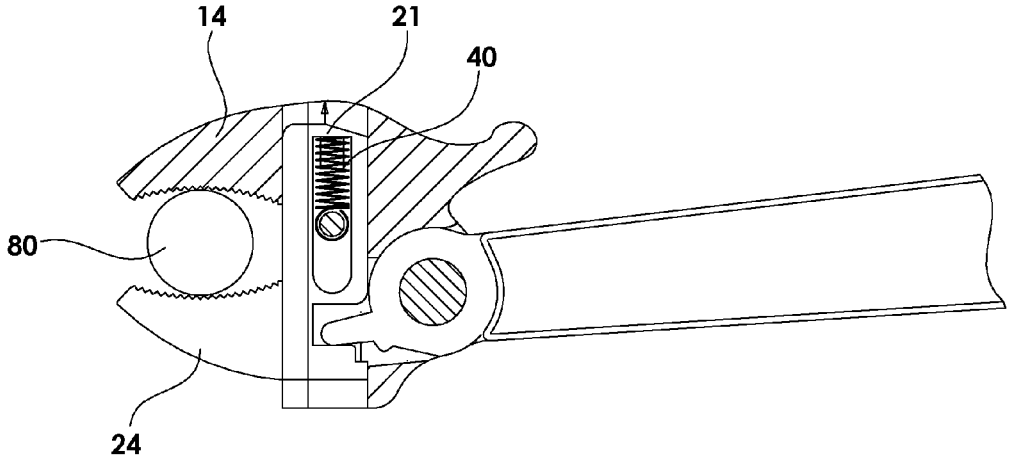
FIG. 5 is a schematic view showing the wrench used to clip the workpiece according to the preferred embodiment of the present invention.
Figure 6:
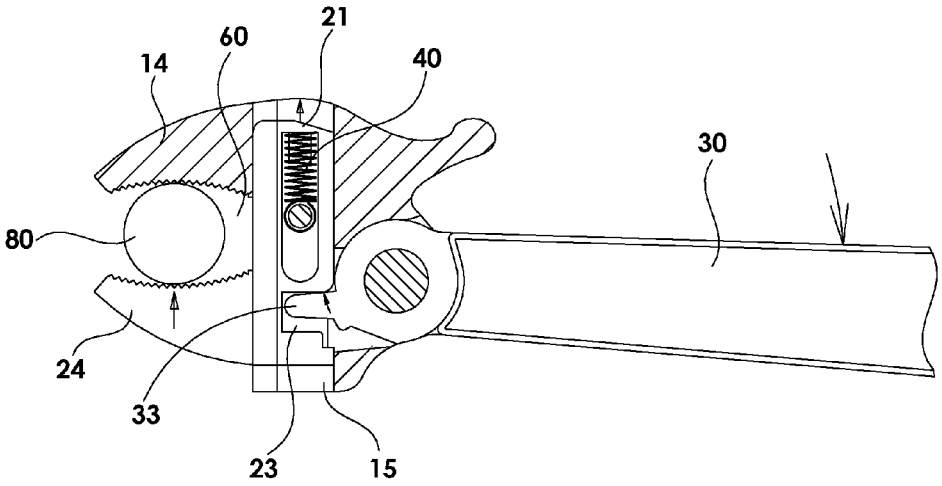
FIG. 6 is a schematic view showing the wrench used to lock the workpiece according to the preferred embodiment of the present invention.
Figure 7:
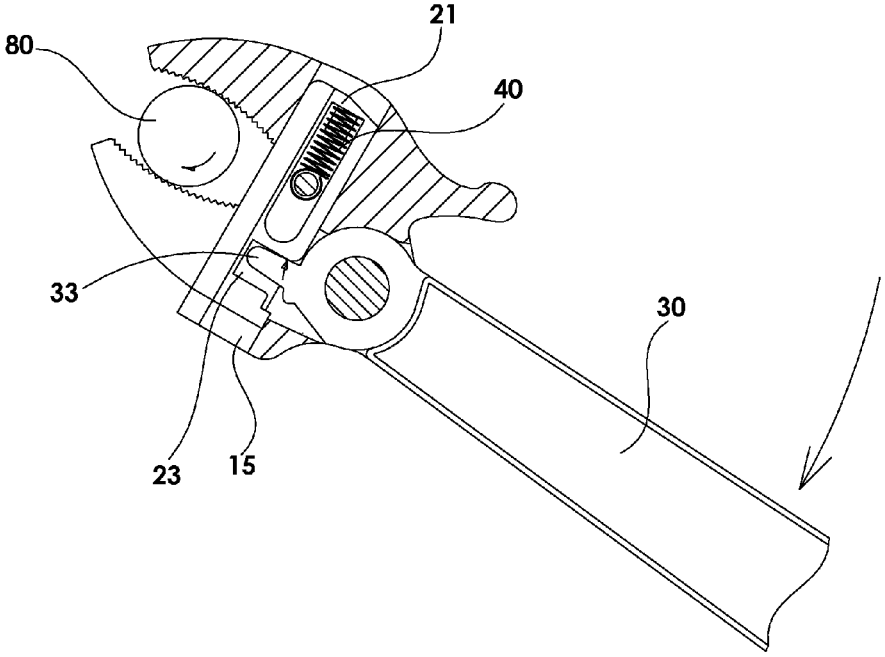
FIG. 7 is a schematic view showing the wrench used to turn the workpiece according to the preferred embodiment of the present invention.
Figure 8:
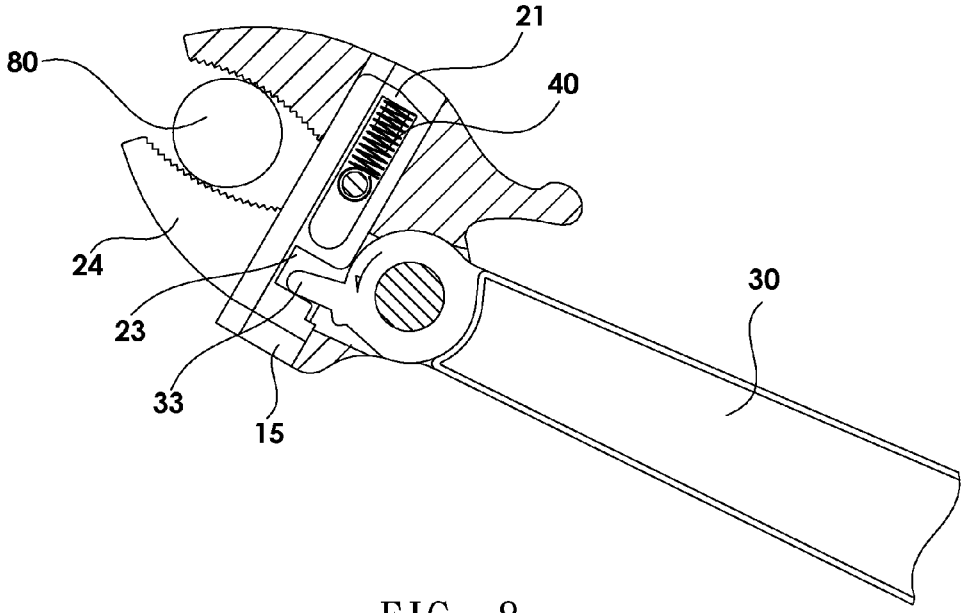
FIG. 8 is a schematic view showing the wrench used to unlock the workpiece according to the preferred embodiment of the present invention.
Figure 9:
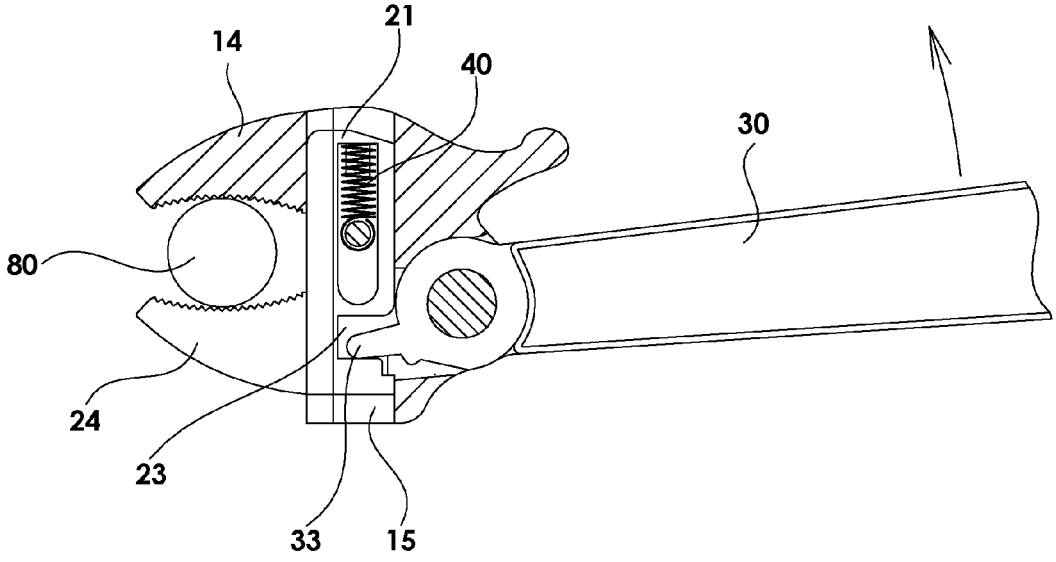
FIG. 9 is a schematic view showing that the handle is pivoted and the workpiece is not linked according to the preferred embodiment of the present invention.

As shown in FIG. 1 and FIG. 2, the adjustable wrench according to a preferred embodiment of the present invention comprises a fixed jaw base 10, an adjustable jaw base 20, and a handle 30. The fixed jaw base 10 comprises an end surface 11 at a front end thereof, a pivot portion 12 at a rear end thereof, a curved first operation portion 13 between one side of the end surface 11 and the pivot portion 12, a first jaw 14 extending forward from another side of the end surface 11, a slide groove 15 formed in the front end of the fixed jaw base 10 and parallel to the end surface 11, a pin hole 16 extending through the fixed jaw base 10 and perpendicular to the slide groove 15, a pivot through hole 17 at the pivot portion 12, and a trough 18 in the pivot portion 12 to communicate with the slide groove 15. The adjustable jaw base 20 comprises a slide rod 21 which corresponds in shape to the slide groove 15 of the fixed jaw base 10 and is slidably movable in the slide groove 15. The slide rod 21 has an elongated spring room 22 and a poke recess 23 at one side of the spring room 22. A spring 40 is provided in the spring room 22. One end of the spring 40 is fixed to a pin member 50 inserted in the pin hole 16, and another end of the spring 40 is in the spring room 22 and normally pushes the slide rod 21 to move towards the first jaw 14. The slide rod 21 has a second jaw 24 extending forward from a front end thereof and corresponding to the first jaw 14. The second jaw 24 is against the end surface 11 and moved along with movement of the slide rod 21 in the slide groove 15 to adjust the gap between the first and second jaws 14, 24 to form a space 60 to clip an object. The handle 30 has a connection portion 31 at one end thereof. The connection portion 31 is inserted into the trough 18 of the pivot portion 12 of the fixed jaw base 10. The connection portion 31 has a connection hole 32 and a poke rod 33 corresponding to the poke recess 23 of the slide rod 21 of the adjustable jaw base 20. An axle pin 70 is inserted through the pivot hole 17 and the connection hole 32 to connect the pivot portion 12 and the connection portion 31. The poke rod 33 is normally inserted in the poke recess 23 of the slide rod 21. As shown in FIG. 3, the user holds the handle 30 to push the first operation portion 13, and then the fixed jaw base 10 is pivoted about the axle pin 70. As shown in FIG. 4, the poke rod 33 of the handle 30 is in the poke recess 23 to stop the slide rod 21 of the adjustable jaw base 20 during swing or after swing, such that the slide rod 21 of the adjustable jaw base 20 is slid in the slide groove 15 of the fixed jaw base 10 relative to the first jaw 14. Through the compression or damping effect of the spring 40, the space 60 can be quickly adjusted in a manual way according to the size of a workpiece 80. When the first operation portion 13 is released as shown in FIG. 5, the slide rod 21 is pushed back by the force of the spring 40. The workpiece 80 is clipped quickly by the first and second jaw portions 14, 24. As shown in FIG. 6, when the handle 30 is pivoted clockwise, the poke rod 33 is moved in the poke recess 23 of the slide rod 211 towards the first jaw 14 and the space 60 is reduced so that the workpiece 80 in the space 60 is clipped tightly by the first and second jaws 14, 24. As shown in FIG. 7, the handle 30 is further turned to bring rotation (clockwise rotation) of the workpiece 80. As shown in FIG. 8, when the handle 30 is turned reversely (counterclockwise), the poke rod 33 is moved reversely in the poke recess 23 and the force of the second jaw 24 to clip the workpiece 80. As shown in FIG. 9, the workpiece 80 is not driven by the handle 30. The handle 30 only brings the first and second jaws 14, 24 to return. At this time, the slide rod 21 is still biased by the spring 40 so the first and second jaws 14, 24 keep the state to clip workpiece 80. When the reverse turning of the handle 30 is stopped, the workpiece 80 is turned clockwise as shown in FIG. 6 and FIG. 7. The workpiece 80 is turned continuously at a certain operation angle. As shown in FIG. 1 and FIG. 2, the slide rod 21 of the adjustable jaw base 20 is slid in the slide groove 15 of the fixed jaw base 10 to adjust the size of the space 60. The poke rod 33 of the handle 30 is located in the poke recess 23 of the slide rod 21 to activate or limit the slide rod 21. The spring 40 in the slide rod 21 is adapted to respond to the force of the poke rod 33. Accordingly, the first operation portion 13 at one side of the fixed jaw base 10 is for the user to adjust the space 60 with his/her finger to provide convenience when in use. Particularly, the poke rod 33 of the handle 30 is in the poke recess 23 to act on the slide rod 21 about at the central position. This can provide a stable action force and prevent the slide rod 21 in the slide grove 15 from being jammed, having a smooth operation to turn the workpiece 80 continuously.

Figure 10:
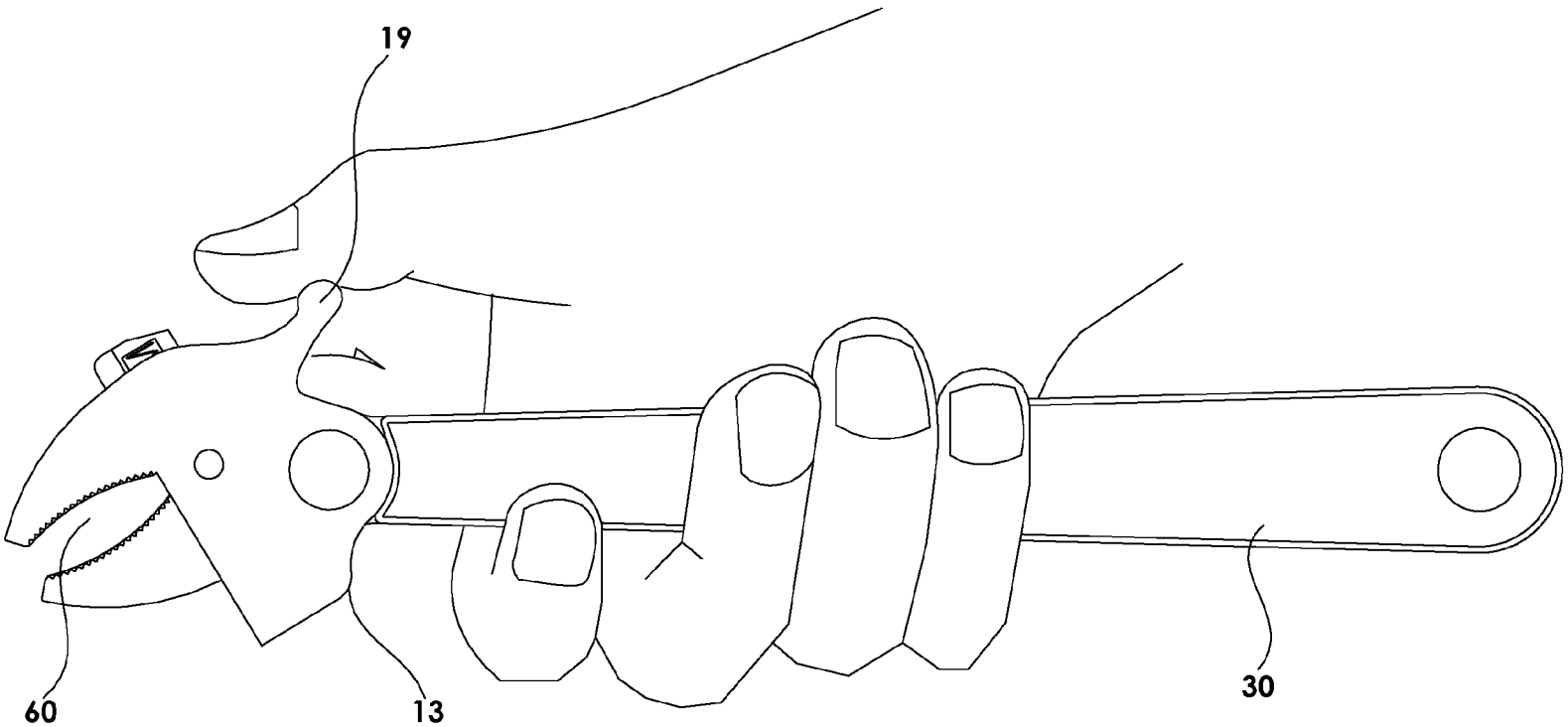
FIG. 10 is a schematic view showing another operation way according to the preferred embodiment of the present invention.

According to the aforesaid embodiment, as shown in FIG. 1 and FIG. 2, the curved first operation portion 13 is located between one side of the end surface 11 and the pivot portion 12, and the first jaw 14 extends forward from the other side of the end surface 11. The fixed jaw base 10 further has a protruding second operation 19 which is disposed between the first jaw 14 and the pivot portion 12 and corresponds to the first operation portion 13. As shown in FIG. 10, when the user holds the handle 30, the second operation portion 19 is selectively pressed downward to adjust the size of the space 60. As shown in FIG. 3 and FIG. 10, both the first and second operation portions 13, 19 are able to adjust the space 60. Thus, no matter the workpiece is turned clockwise or counterclockwise, the user can hold the handle 30 to push the first operation portion 13 or to press the second operation portion 19 downward to adjust the space 60. The present invention can be used conveniently and conforms to anthropometry.

According to the aforesaid embodiment, as shown in FIG. 1 and FIG. 2, the pivot portion 12 of the fixed jaw base 10 is connected with the connection portion 31 of the handle 30. The connection portion 31 is inserted into the trough 18 and the poke rod 33 extends into the poke recess 23 of the slide rod 21 of the adjustable jaw base 20. The poke recess 23 is a U-shaped recess, and has a width slightly greater than the width of the poke rod 33 and a depth slightly greater than the length of the poke rod 33. As shown in FIG. 6 to FIG. 9, when the handle 30 is pivoted, the poke rod 33 will apply an axial force to the side wall of the poke recess 23 to push the slide rod 21, preventing the poke rod 33 from compressing the slide rod 21 to diverge from the center of the slide groove 15. This ensures that the compressing elasticity of the spring 40 won't be influenced and the slide rod 21 can be returned effectively. As shown in FIG. 1 and FIG. 2, the poke rod 33 extends into the U-shaped poke recess 23 of the slide rod 21. The slide rod 21 has a stepped notch 25 next to the poke recess 23. The poke rod 33 has a protrusion 34 corresponding to the notch 25. When the user holds the handle 30 and doesn't operate the wrench to clip an object, the slide rod 21 biased by the spring 40 is positioned by the protrusion 34 of the poke rod 33 to engage with the notch 25, preventing the fixed jaw base 10 and the adjustable jaw base 20 at the front end of the handle 30 from swaying before use.

According to the aforesaid embodiment, as shown in FIG. 1 and FIG. 2, the slide rod 21 of the adjustable jaw base 20 has the elongated spring room 22. A limit pin 220 is provided inside the spring room 22. The spring 40 is disposed in the spring room 22. One end of the spring 40 is fixed by the pin member 50, and the other end of the spring 40 is fitted on the limit pin 220 to push the slide rod 21. Through the limit pin 220, the spring 40 is located in the spring room 22 stably.

According to the aforesaid embodiment, as shown in FIG. 1 and FIG. 2, the space 60 is defined between the first jaw 14 of the fixed jaw base 10 and the second jaw 24 of the adjustable jaw base 20. The first and second jaws 14, 24 have curved anti-slip surfaces 140, 240 which face the space 60 and have snap threads thereon. As shown in FIG. 6 to FIG. 9, when the wrench tool is used to clip a circular-tube or a circular-rod workpiece 80, the anti-slip surfaces 140, 240 are beneficial to clip the workpiece for operation.

Figure 11:
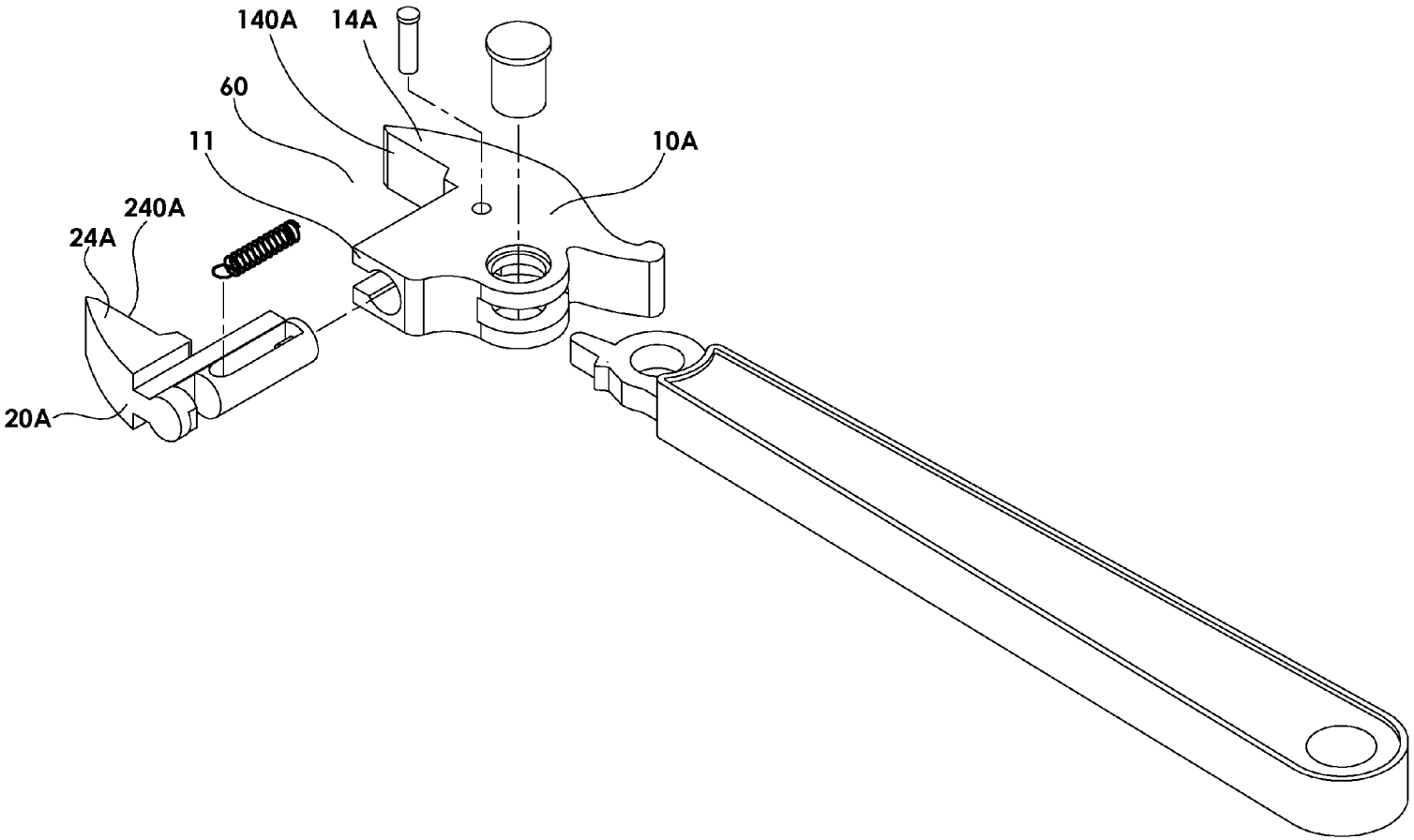
FIG. 11 is an exploded view showing another embodiment of the first and second jaws.
Figure 12:
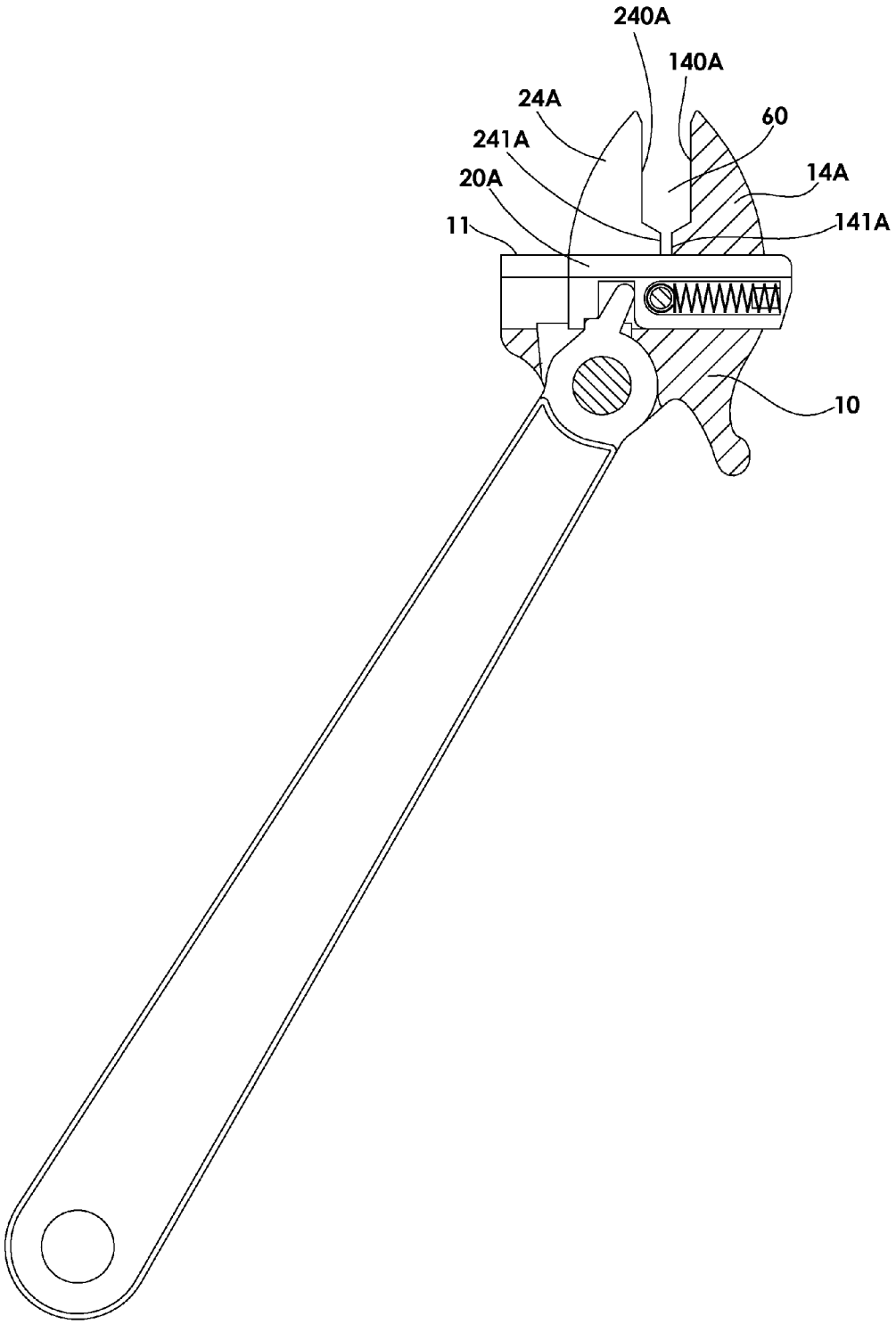
FIG. 12 is a sectional view of FIG. 11.
Figure 13:
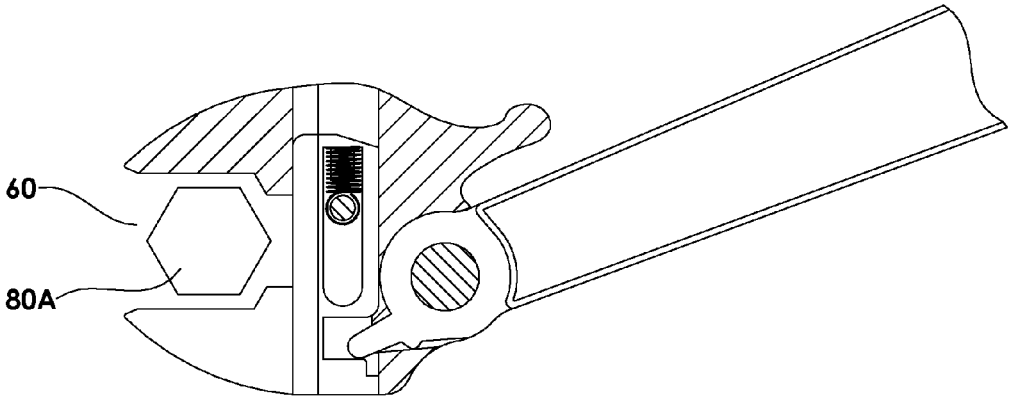
FIG. 13 is a schematic view showing that the space is adjusted to clip an object according to the embodiment of FIG. 11.
Figure 14:
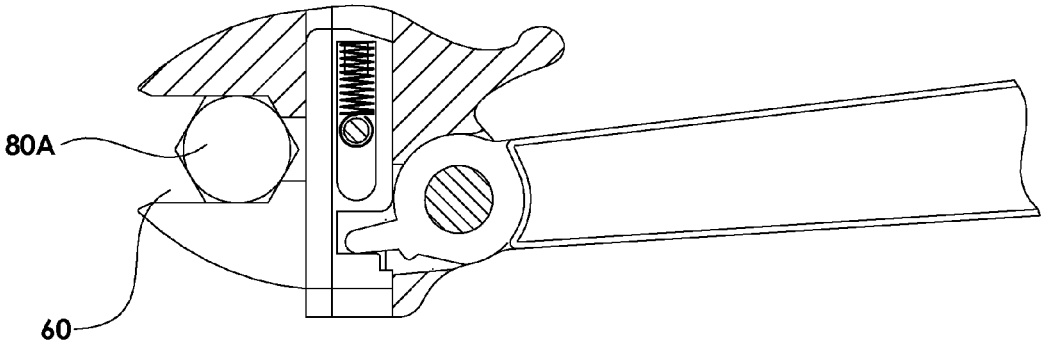
FIG. 14 is a schematic view showing the wrench used to clip the workpiece according to the embodiment of FIG. 11.
Figure 15:
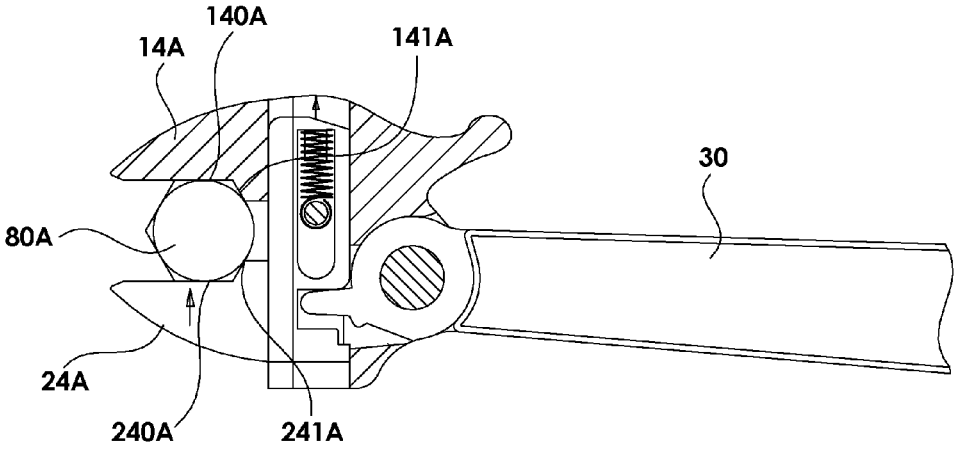
FIG. 15 is a schematic view showing the wrench used to lock the workpiece according to the embodiment of FIG. 11.
Figure 16:
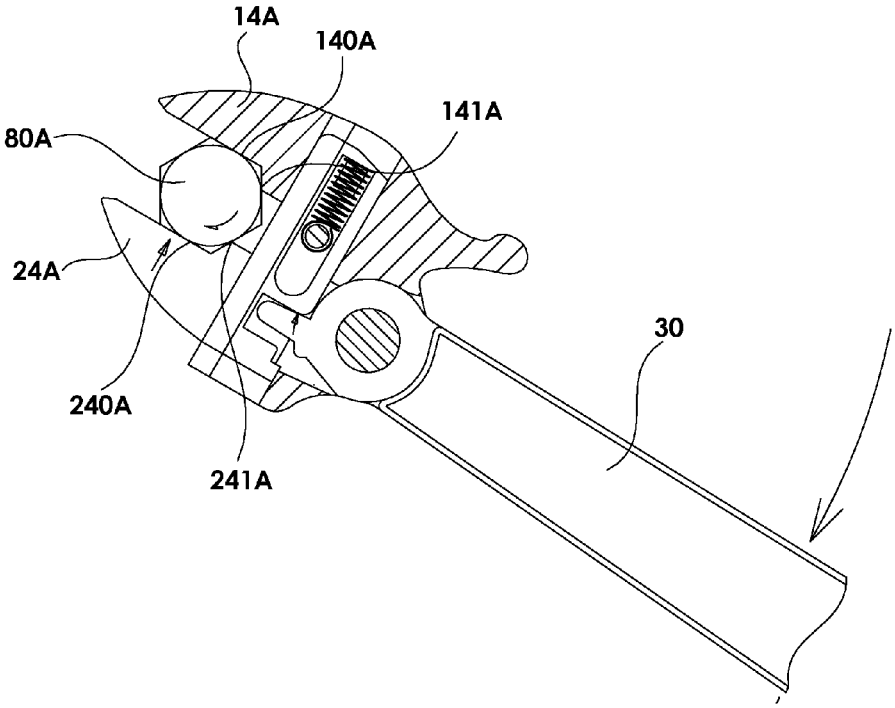
FIG. 16 is a schematic view showing the wrench used to turn the workpiece according to the embodiment of FIG. 11.
Figure 17:
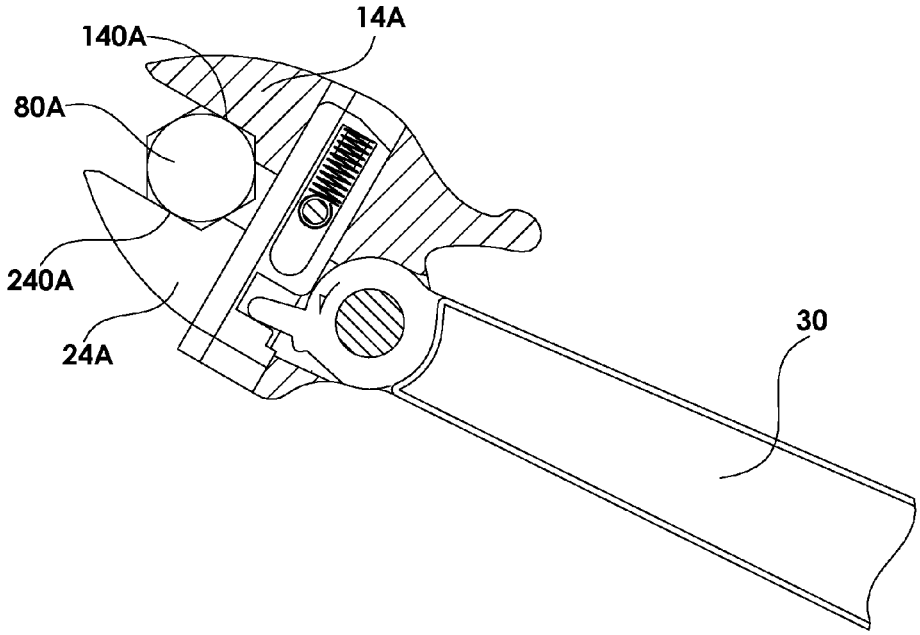
FIG. 17 is a schematic view showing the wrench used to unlock the workpiece according to the embodiment of FIG. 11.
Figure 18:
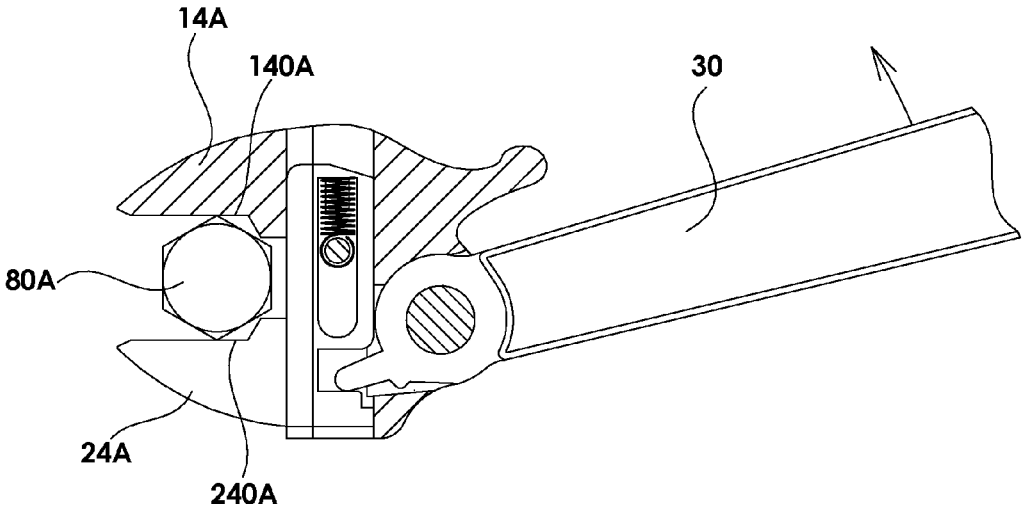
FIG. 18 is a schematic view showing that the flat surfaces of the first and second jaws hold against the angled portions of the workpiece when the handle is returned according to the embodiment of FIG. 11.

FIG. 11 and FIG. 12 show another embodiment of the present invention, which is used to clip screws or nuts. The space 60 is defined between the first jaw 14A of the fixed jaw base 10A and the second jaw 24A of the adjustable jaw base 20A. The first jaw 14A is located opposite the second jaw 24A. The first and second jaws 14A, 24A have flat surfaces 140A, 240A which are perpendicular to the end surface 11. As shown in FIG. 13 and FIG. 14, the space 60 is adapted to clip a hexagonal screw or a hexagonal nut 80A. As shown in FIG. 15 and FIG. 16, the handle 30 is operated to turn the workpiece 80A. As shown in FIG. 17 and FIG. 18, when the handle 30 is returned, the flat surfaces 140A, 240A of the first and second jaws 14A, 24A make the hexagonal screw or nut 80A return to the position as shown in FIG. 15 and FIG. 16 for continuous turning. As shown in FIG. 11 and FIG. 12, the space 60 is defined between the first jaw 14A of the fixed jaw base 10A and the second jaw 24A of the adjustable jaw base 20A. The first and second jaws 14A, 24A have the flat surfaces 140A, 240A facing each other. The first and second jaws 14A, 24A of the fixed jaw base 10A and the adjustable jaw base 20A have bent surfaces 141A, 241A located next to the inner ends of the flat surfaces 140A, 240A and corresponding in shape to the angled portion of a hexagonal screw or nut. As shown in FIG. 15 and FIG. 16, the bent surfaces 141A, 241A are adapted to hold against the angled portion of the workpiece 80A when the flat surfaces 140A, 240A of the first and second jaws 14A, 24A clip the flat portion of the workpiece 80A, enhancing the stability of turning.

While the invention has been described in terms of preferred embodiments, those skilled in the art will recognize that the invention can be practiced with modifications within the spirit and scope of the appended claims.

What is claimed is:

1. An adjustable wrench, comprising a fixed jaw base, an adjustable jaw base and a handle, the fixed jaw base comprising an end surface at a front end thereof, a pivot portion at a rear end thereof, a curved first operation portion between one side of the end surface and the pivot portion, a first jaw extending forward from another side of the end surface, a slide groove formed in the front end of the fixed jaw base and parallel to the end surface, a pin hole extending through the fixed jaw base and perpendicular to the slide groove, a pivot through hole at the pivot portion and a trough in the pivot portion to communicate with the slide groove; the adjustable jaw base comprising a slide rod which corresponds in shape to the slide groove of the fixed jaw base and is slidably movable in the slide groove, the slide rod having an elongated spring room and a poke recess at one side of the spring room, a spring being provided in the spring room, one end of the spring being fixed to a pin member inserted in the pin hole, another end of the spring being in the spring room and pushing the slide rod to move towards the first jaw, the slide rod having a second jaw extending forward from a front end thereof and corresponding in position to the first jaw, the second jaw being against the end surface and moved along with movement of the slide rod in the slide groove to adjust a space defined between the first and second jaws, the space being adapted to clip an object; the handle having a connection portion at one end thereof, the connection portion being inserted into the trough of the pivot portion of the fixed jaw base, the connection portion having a connection hole and a poke rod corresponding to the poke recess of the slide rod of the adjustable jaw base, an axle pin being inserted through the pivot hole and the connection hole to connect the pivot portion and the connection portion, the poke rod being inserted in the poke recess of the slide rod;

wherein the poke recess is a U-shaped recess, and has a width slightly greater than a width of the poke rod and a depth slightly greater than a length of the poke rod; and wherein the poke rod extends into the U-shaped poke recess of the slide rod, the slide rod having a stepped notch next to the poke recess, the poke rod having a protrusion corresponding to the notch.

2. The adjustable wrench as claimed in claim 1, wherein the fixed jaw base further has a protruding second operation which is disposed between the first jaw and the pivot portion and corresponds to the first operation portion.

3. The adjustable wrench as claimed in claim 1, wherein a limit pin is provided inside the spring room of the slide rod of the adjustable jaw base.

4. The adjustable wrench as claimed in claim 1, wherein the first and second jaws of the fixed jaw base and the adjustable jaw base have curved anti-slip surfaces which face the space and have snap threads thereon.

5. The adjustable wrench as claimed in claim 1, wherein the first and second jaws of the fixed jaw base and the adjustable jaw base have flat surfaces which face the space and are perpendicular to the end surface.

6. The adjustable wrench as claimed in claim 5, wherein the first and second jaws of the fixed jaw base and the adjustable jaw base have bent surfaces located next to inner ends of the flat surfaces and corresponding in shape to an angled portion of a hexagonal screw or nut.

* * * * *